United States Patent [19]

Noguchi et al.

[11] Patent Number: 4,771,318

[45] Date of Patent: Sep. 13, 1988

[54] COPYING MACHINE WITH MULTIPLE TRANSPORT FUNCTION

[75] Inventors: Teruhiko Noguchi, Sakai; Itaru Kawabata, Kashiwara; Hiroshi Kinashi, Uji; Yoshiharu Tsujimoto, Suita; Hiromu Sasaki, Yamatokoriyama, all of Japan

[73] Assignee: Sharp Kabushiki Kaisha, Tokyo, Japan

[21] Appl. No.: 87,710

[22] Filed: Aug. 21, 1987

[30] Foreign Application Priority Data

Aug. 22, 1986 [JP] Japan ..... 61-128482[U]

[51] Int. Cl.[4] ..... G03G 21/00; G03G 15/14

[52] U.S. Cl. ..... 355/14 CH; 355/3 TR; 355/14 TR; 355/24; 355/26; 355/14 SH; 271/900

[58] Field of Search ..... 355/14 TR, 14 SH, 3 SH, 355/3 TR, 14 R, 14 CH, 24, 26; 271/307, 312, 900

[56] References Cited

U.S. PATENT DOCUMENTS 4,076,407 2/1978 Place ..... 355/14 TR
4,536,082 8/1985 Motohashi et al. ..... 355/14 TR
4,640,606 2/1987 Inamoto ..... 355/14 TR

FOREIGN PATENT DOCUMENTS 55-43527 3/1980 Japan ..... 355/3 SH

*Primary Examiner*—R. L. Moses
*Attorney, Agent, or Firm*—Birch, Stewart, Kolasch & Birch

[57] ABSTRACT

A copying machine with a multiple transport function having a separation charger for separating from the photoreceptor surface copy paper with an image transferred thereon and a circulating transport passage formed from the paper discharge block to the paper feed block so that it is possible to select the single-sided copy mode for allowing the copy paper to be discharged outside the copying machine after the copying process, the duplex copy mode for allowing the copy paper undergoing one copying process to be led through the circulating transport passage to the copying process block as reversed, or the composite copy mode for allowing the copy paper undergoing one copying process to be led through the circulating transport passage to the copying process block without being reversed. The copying machine with a multiple transport function includes a current controller which sets current applied to the separation charger for the second copying process at a larger value in the composite copy mode and at a smaller value in the duplex copy mode than that for the copying process in the single-sided copy mode.

3 Claims, 3 Drawing Sheets

COPYING MACHINE WITH MULTIPLE TRANSPORT FUNCTION

BACKGROUND OF THE INVENTION

The present invention relates to a copying machine with a multiple transport function. The copying machine contains a separation charger for separating copy paper from the photoreceptor surface by corona discharge in the copying process and a circulating transport passage communicating the paper discharge block with the paper feed block in which copying machine the duplex or composite copy mode can be selected.

Electrophotographic copying machines transfer a toner image formed on the photoreceptor surface onto copy paper and lead the copy paper to the image fixing unit after completing a transfer process. So far, the copying process suitable for copying machines with a multiple transport function has not yet been proposed.

SUMMARY OF THE INVENTION

An object of the present invention is to provide a copying machine with a multiple transport function in which current supplied to a separation charger for the second copying process in the composite or duplex copy mode is set at a different value from the one for the copying process in the single-sided copy mode so as to control the output of the separation charger according to the contact state between the copy paper and the photoreceptor surface in the second copying process, thereby ensuring efficient and stable transfer of a toner image onto the copy paper and maintaining stable transportation of the copy paper.

Briefly described, in accordance with the present invention, a copying machine with a multiple transport function contains a separation charger for separating from the photoreceptor surface copy paper having an image transferred thereon and a circulating transport passage formed from the paper discharge block to the paper feed block, so that it is possible to select the single-sided copy mode in which copy paper undergoing one copying process is discharged outside the copying machine, the duplex copy mode in which copy paper undergoing one copying process is led to the circulating transport passage and supplied to the copying process block again as reversed, or the composite copy mode in which copy paper undergoing one copying process is led through the circulating transport passage to the copying process block again without being reversed. The copying machine of the present invention is characterized in that it includes current control means which sets current to be applied to the separation charger for the second copying process at a larger value in the composite copy mode, and at a smaller value in the duplex copy mode than that for the copying process in the single-sided copy mode.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENT

Figure 2:
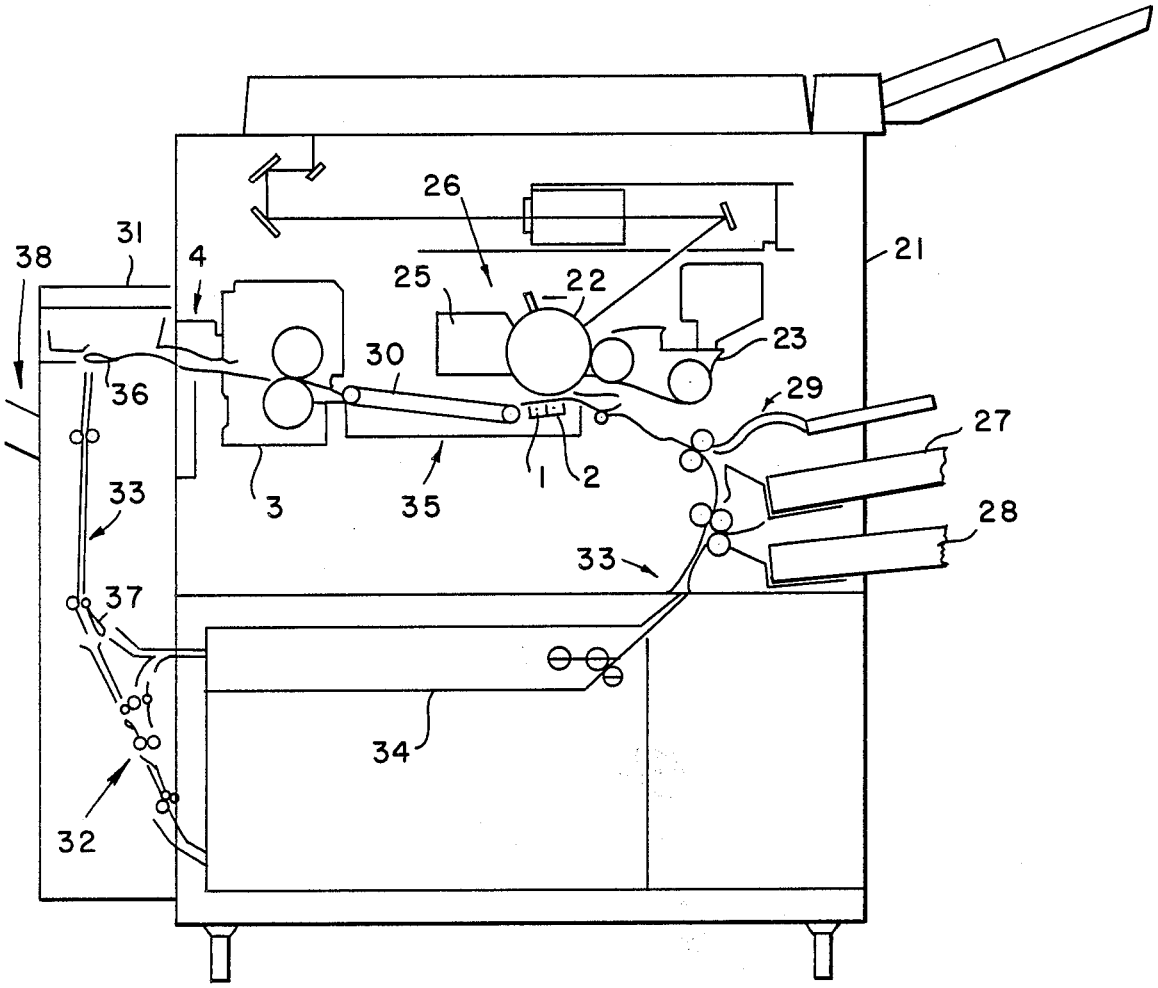
FIG. 2 is a vertical section showing the schematic construction of the copying machine with the multiple transport function of the present invention.

FIG. 2 is a vertical section showing the construction of an embodiment of the copying machine with a multiple transport function of the present invention.

A photoreceptor drum 22 is mounted in the center of a copying machine main body 21, constituting a copying process block 26 together with a developing unit 23, a transfer charger 2, a separation charger 1, and a cleaner 25, etc. Paper cassettes 27 and 28 are mounted on one side of the copying machine main body 21 to form a paper feed block 29. A paper discharge block 4 is formed and a soter 31 is mounted on the other side of the copying machine main body 21. A transport belt 30 and an image fixing unit 3 are arranged between the copying process block 26 and the paper discharge block 4, thus providing a paper transport passage 35 running from the paper feed block 29 via the copying process block 26 to the paper discharge block 4.

Flappers 36 and 37 are mounted in the sorter 31 which contains a part of a circulating transport passage 33 and a switchback transport passage 32. The flappers 36 and 37 are free to swing. The flapper 36 switches the paper transport passage 35 either to a paper discharge tray 38 or to the circulating transport passage 33. The flapper 37 switches the part of the circulating transport passage 35 either to the switchback transport passage 32 or to an intermediate tray 34. A part of the circulating transport passage 33 is also formed between the intermediate tray 34 and the paper feed block 29.

Figure 3:
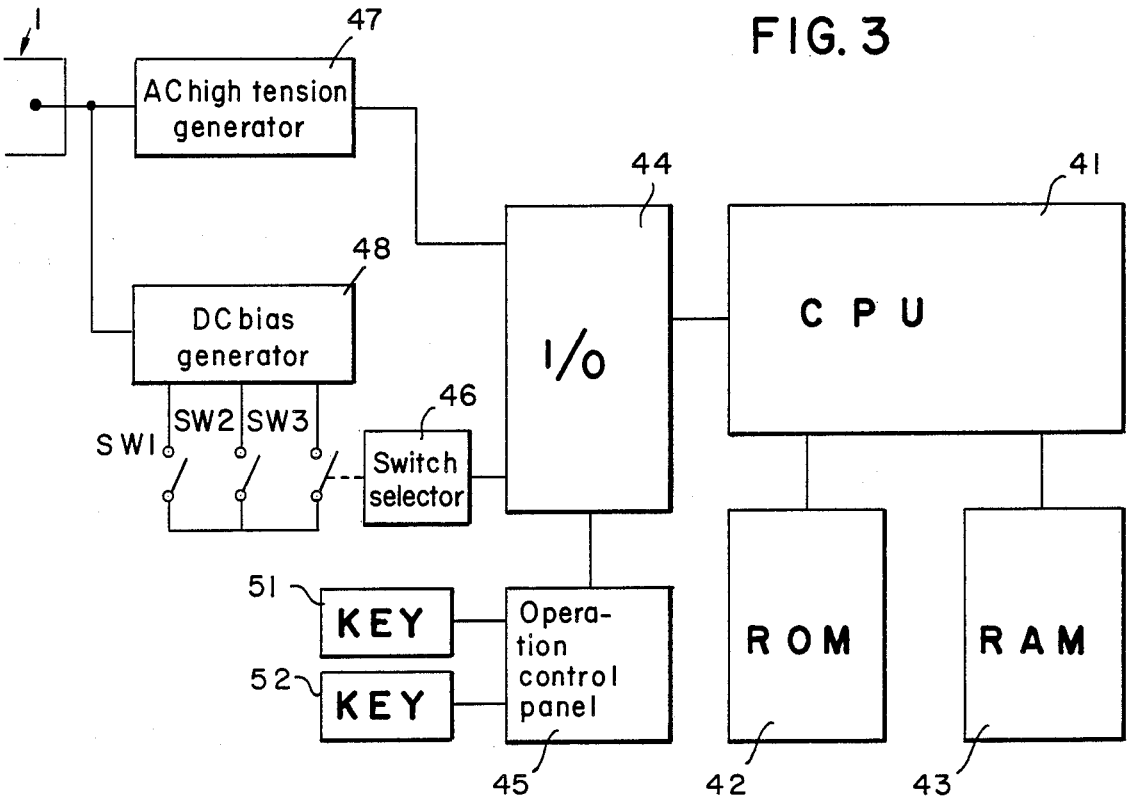
FIG. 3 is a block diagram showing the control section of the copying machine with the multiple transport function of the present invention.

FIG. 3 is a block diagram showing the control section of the copying machine with the multiple transport function of the present invention.

When an operation key such as a composite copy mode key 51 or a duplex copy mode key 52 is depressed on an operation control panel 45, the ON data is input through an I/O interface 44 into a CPU 41 and stored in an appropriate memory area of a RAM 43. A ROM 42 stores programs for controlling each device according to the data input. The CPU 41 outputs control data via the I/O interface 41 according to the program in the ROM 42. In accordance witn the control data output, an AC high tension generator 47 applies high AC voltage to the separation charger 1, and a switch selector 46 selectively turns ON one of switches SW1, SW2 and SW3 provided on a DC bias generator 48.

Figure 1:
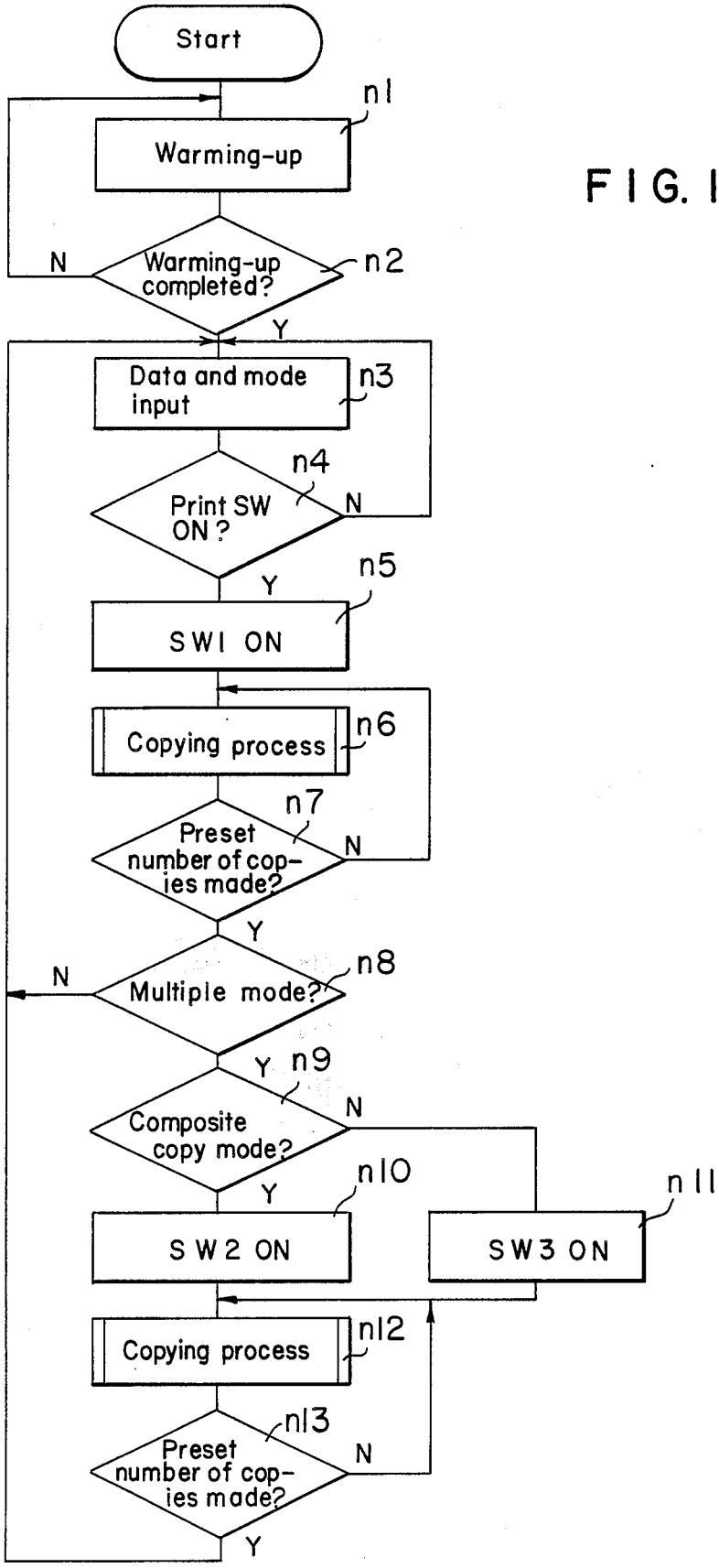
FIG. 1 is a flow chart showing the operation process of an embodiment of the copying machine with a multiple transport function of the present invention.

FIG. 1 is a flow chart showing the operation process of the copying machine with the multiple transport function of the present invention.

Referring to the flow chart, when the copying machine 21 is turned ON, a warm-up operation is started, copy data and mode are input to the copying machine after the warm-up operation, and it is judged whether or not the print switch is depressed (n1 to n4). If the print switch is depressed ON, the switch SW1 is made ON (n5) so that copying process is started (n6). When the preset number of copies has been made (n7), it is judged whether or not the multiple transport mode has been selected by depressing either the composite copy mode key 51 or the duplex copy mode key 52 (n8).

If the print switch had been depressed without operating either the composite or the duplex copy mode key 51 or 52, the operation process returns to step n3.

If the multiple transport mode is found, to be selected, it is judged whether or not the composite copy mode key 51 had been operated (n9). If yes, the switch selector 46 selects the switch SW2 to be ON (n10), and if no, the switch selector 46 selects the switch SW3 to be ON (n11).

Figure 4:
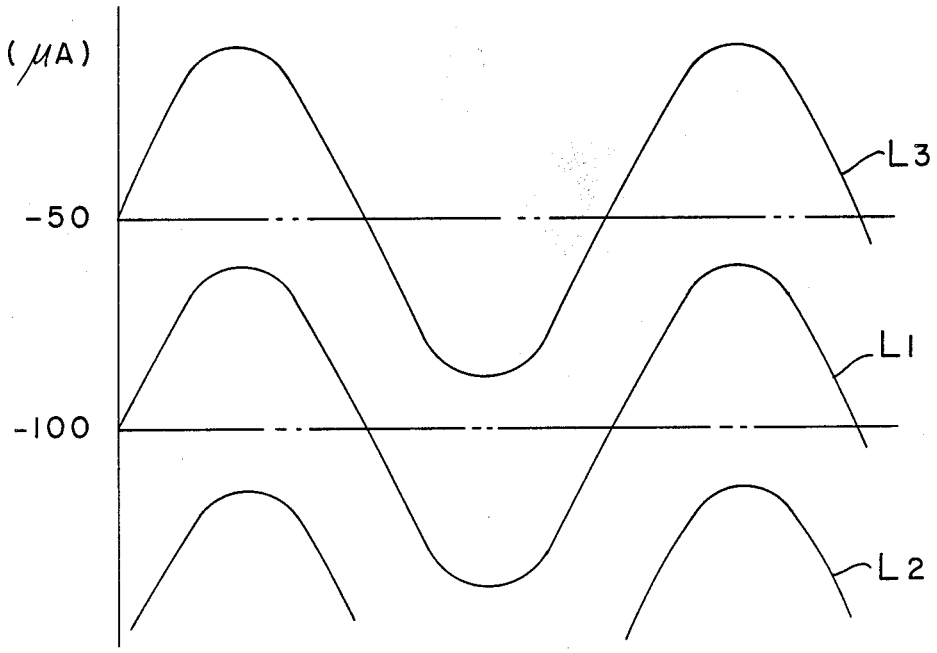
FIG. 4 is a diagram showing current waveforms supplied to the separation charger of the copying machine with the multiple transport function of the present invention.

This operation process of the steps n9 through n11 corresponds to the function of the current control means of the present invention. When the switch SW1 is made ON in the single-sided copy mode, DC bias current to be supplied to the separation charger 1 is set at $-100\ \mu A$ so that current of the waveform L: shown in FIG. 4 is applied to the separation charger 1. When the switch SW2 is made ON for the second copying process in the composite copy mode, DC bias current to be supplied to the separation charger 1 is set at $-150\ \mu A$ so that current of the waveform $L_2$ shown in FIG. 4 is applied to the separation charger 1. When the switch SW3 is made ON for the second copying process in the duplex copy mode, the DC bias current is set at $-50\ \mu A$ so that current of the waveform $L_3$ shown in FIG. 4 is applied to the separation charger 1.

Thus, according to the present invention, the output of the separation charger is increased for the second copying process in the composite copy mode and decreased for the second copying process in the duplex copy mode. Furthermore, current leakage can be prevented by controlling the DC bias current.

With the conventional copying machine with a multiple transport function, a copy paper sheet supplied to the copying process block for the second copying process in the composite copy mode is curled in the same direction as the curvature of the photoreceptor surface, decreasing the separability from the photoreceptor surface, whereas a copy paper sheet supplied to the copying process block for the second copying process in the duplex copy mode is curled in the opposite direction from the curvature of the photoreceptor surface, increasing the separability from the photoreceptor surface. According to the present invention, as described above, the current control means sets the current to be supplied to the separation charger for the second copying process at a larger value in the composite copy mode and at a smaller value in the duplex copy mode than that for the copying process in the single-sided copy mode, so that the output of the separation charger is increased for the second copying process in the composite copy mode and decreased for the second copying process in the duplex copy mode. Consequently, it is possible to maintain appropriate separability of a copy paper sheet from the photoreceptor surface by increasing the separability for the second copying process in the composite copy mode and decreasing the separability for the second copying process in the duplex copy mode, thus ensuring stable transfer of a toner image onto the copy paper sheet and stable transportation of the copy paper sheet.

In short, the copying machine with a multiple transport function of the present invention contains the current control means for setting the current supplied to the separation charger for the second copying process in the duplex or composite copy mode at a value different from that for the copying process in the single-sided copy mode, so that the output of the separation charger is increased in the composite copy mode in which a copy paper sheet has a poor separability, and decreased in the duplex copy mode in which a copy paper sheet has an excessive separability, thereby maintaining an appropriate separability of copy paper from the photoreceptor surface in any of the single-sided, composite and duplex copy modes.

While only certain embodiments of the present invention have been described, it will be apparent to those skilled in the art that various changes and modifications may be made therein without departing from the spirit and scope of the present invention as claimed.

What is claimed is:

1. A copying maching with a multiple transport function comprising:

a separation charger for separating copy paper from the photoreceptor surface, said copy paper having an image transferred thereon;

a circulating transport passage formed from a paper discharge block to a paper feed block for selecting a single-sided copy mode and allowing the copy paper undergoing one copying process to be discharged outside the copying machine;

a duplex copy mode for allowing the copy paper undergoing one copying process to be led through said circulation transport passage to the copying process block as reversed;

a composite copy mode for allowing the copy paper undergoing one copying process to be led through said circulating transport passage to the copying process block without being reversed; and current control means for changing current applied to said separation charger according to the selected copy mode.

2. The copying machine with a multiple transport function according to claim 1, wherein said current control means sets current applied to said separation charger for the second copying process at a larger value in the composite copy mode and at a smaller value in the duplex copy mode than that for the copying process in the single-sided copy mode.

3. The copying machine with a multiple transport function according to claim 2, wherein said current control by said current control means permits the output of said separation charger to be increased in the composite copy mode where copy paper has a poor separability and to be decreased in the duplex copy mode where copy paper has an excessive separability.

* * * * *